US009635936B1

(12) United States Patent
Swislow et al.

(10) Patent No.: US 9,635,936 B1
(45) Date of Patent: May 2, 2017

(54) FOOD PRESENTATION SYSTEM

(71) Applicants: Robert Swislow, Chicago, IL (US); Steve Levin, Chicago, IL (US)

(72) Inventors: Robert Swislow, Chicago, IL (US); Steve Levin, Chicago, IL (US)

( * ) Notice: Subject to any disclaimer, the term of this patent is extended or adjusted under 35 U.S.C. 154(b) by 0 days.

(21) Appl. No.: 14/883,549

(22) Filed: Oct. 14, 2015

Related U.S. Application Data

(60) Provisional application No. 62/066,199, filed on Oct. 20, 2014.

(51) Int. Cl.

| | |
|---|---|
| ***A47B 31/00*** | (2006.01) |
| ***A47F 5/00*** | (2006.01) |
| ***A47F 7/00*** | (2006.01) |
| ***A47F 7/28*** | (2006.01) |
| ***A47F 10/04*** | (2006.01) |
| ***A47F 10/06*** | (2006.01) |
| ***A47G 11/00*** | (2006.01) |
| ***G09F 7/18*** | (2006.01) |
| *A47F 10/02* | (2006.01) |

(52) U.S. Cl.
CPC ..... *A47B 31/00* (2013.01); *A47F 5/0043* (2013.01); *A47F 7/0021* (2013.01); *A47F 7/0064* (2013.01); *A47F 7/28* (2013.01); *A47F 10/04* (2013.01); *A47F 10/06* (2013.01); *A47G 11/003* (2013.01); *G09F 7/18* (2013.01); *A47B 2031/002* (2013.01); *A47B 2031/003* (2013.01); *A47F 2010/025* (2013.01); *A47F 2010/065* (2013.01); *G09F 2007/1856* (2013.01)

(58) Field of Classification Search
CPC ..... A47B 31/00; A47B 2031/002; A47B 2031/003; A47F 10/06; A47F 2010/065; A47F 7/0064; A47F 5/0043
See application file for complete search history.

(56) References Cited

U.S. PATENT DOCUMENTS

| | | | | | |
|---|---|---|---|---|---|
| 1,235,539 | A * | 8/1917 | Abadie | ..... | A47B 31/00 126/348 |
| 1,877,217 | A * | 9/1932 | Anderson | ..... | A47B 31/00 126/268 |
| 1,985,412 | A * | 12/1934 | Jackson | ..... | A47B 31/00 126/146 |

(Continued)

FOREIGN PATENT DOCUMENTS

| | | | | | |
|---|---|---|---|---|---|
| FR | 2228353 | A5 * | 11/1974 | ..... | A47B 31/06 |
| FR | 2654057 | A1 * | 5/1991 | ..... | A47B 31/06 |
| FR | 2752701 | A1 * | 3/1998 | ..... | A47B 31/00 |

*Primary Examiner* — Stanton L Krycinski
(74) *Attorney, Agent, or Firm* — Quickpatents, LLC; Kevin Prince

(57) ABSTRACT

A food display system for display food items on a table includes a cart having a tray storage recess in either side thereof, a bin storage area in a top side thereof, and a bin holder storage recess in a rear side thereof. A plurality of nestable trays are each storable in the at least one tray storage recess of each side of the cart. A plurality of bins are each storable in the bin storage area of the top of the cart. A plurality of nestable bin holders are each adapted for displaying at least one of the bins while resting on one of the tables. In a deployed configuration, the cart is positioned in front of the table, and each of the bin holders is placed on the table and each holding at least one of the bins which display the food items.

8 Claims, 8 Drawing Sheets

(56) References Cited

U.S. PATENT DOCUMENTS 2,490,588 A * 12/1949 Haloski ..... A47B 31/00 193/1
2,886,395 A * 5/1959 Cahn ..... A47F 10/06 312/229
2,900,045 A * 8/1959 Conklin ..... A47J 36/2483 186/44
2,919,339 A * 12/1959 Hilliker ..... A47B 31/02 126/21 R
3,162,495 A * 12/1964 Swift ..... A47B 31/02 108/23
3,205,033 A * 9/1965 Stentz ..... A47B 31/02 165/48.1
3,275,393 A * 9/1966 Conklin ..... A47B 31/02 219/214
3,297,375 A * 1/1967 Reeves ..... A47F 3/00 108/23
3,472,392 A * 10/1969 Hahn ..... A47B 31/00 211/126.14
3,478,193 A * 11/1969 Molitor ..... A47B 31/02 126/268
3,512,826 A * 5/1970 Hahn ..... A47B 31/00 211/126.14
3,874,479 A * 4/1975 Onori ..... A47F 10/06 186/44
3,877,744 A * 4/1975 Miller ..... B62B 3/008 108/38
3,984,162 A * 10/1976 Zozzaro ..... A47B 31/00 312/100
4,076,349 A * 2/1978 Gettleman ..... A47B 31/02 312/236
4,156,449 A * 5/1979 Petersen ..... A47F 10/06 160/120
4,820,003 A * 4/1989 Lloyd ..... A47B 31/00 312/234
4,974,500 A * 12/1990 Boyd ..... A47B 31/02 221/96
5,011,240 A * 4/1991 Kelley ..... A47B 31/00 312/249.12
5,016,948 A * 5/1991 Welch ..... A47B 88/0451 211/126.15
5,159,973 A * 11/1992 Pennington ..... A47J 39/006 126/400
5,163,536 A 11/1992 Tuhro
5,182,924 A * 2/1993 Trulaske, Sr. ..... A47F 3/0443 62/255
5,240,320 A * 8/1993 Yerman ..... A47B 57/52 312/236
6,034,355 A * 3/2000 Naderi ..... A47J 27/004 219/386
6,068,356 A * 5/2000 Giuseppe ..... A47B 31/00 280/47.35
6,474,677 B2 * 11/2002 Kasuya ..... A47B 31/06 108/115
6,533,372 B1 * 3/2003 McCrossin ..... A47B 31/00 108/180
6,561,599 B2 * 5/2003 Itakura ..... A47B 46/00 312/205
6,598,514 B2 * 7/2003 Leggi ..... A47F 10/06 126/276
7,040,723 B2 * 5/2006 Matus, Jr. ..... A47F 10/06 312/137
7,101,000 B2 9/2006 DeMars
7,156,207 B2 * 1/2007 Simon ..... A47F 10/06 186/38
7,536,868 B1 * 5/2009 Ward ..... A47F 3/0404 62/237
7,544,915 B2 * 6/2009 Hu ..... B62B 3/006 219/387
7,780,250 B2 8/2010 Knowles
7,950,679 B2 * 5/2011 Claffy ..... A47J 39/006 280/47.35
8,322,732 B2 * 12/2012 McKay ..... A47B 31/00 280/47.34
8,522,769 B2 9/2013 Ducate
8,696,075 B1 * 4/2014 Rios ..... A47F 10/06 126/25 R
8,857,346 B2 * 10/2014 Khanjian ..... A47B 3/087 108/26
9,089,210 B2 * 7/2015 Kool
2003/0233814 A1 * 12/2003 Ng ..... A47F 10/06 53/474
2004/0140740 A1 * 7/2004 Gauss ..... A47F 9/00 312/140.2
2006/0175940 A1 * 8/2006 English ..... A47F 7/0071 312/137
2007/0145870 A1 * 6/2007 Uffner ..... A47B 31/00 312/257.1
2007/0221449 A1 * 9/2007 Wellen ..... A47F 10/06 186/44
2008/0067900 A1 * 3/2008 Marshall ..... A47B 87/008 312/108
2012/0204765 A1 8/2012 Khanjian

* cited by examiner

FOOD PRESENTATION SYSTEM

CROSS-REFERENCE TO RELATED APPLICATIONS

This application claims the benefit of U.S. Provisional Patent Application 62/066,199, filed on Oct. 20, 2014, and incorporated herein by reference.

STATEMENT REGARDING FEDERALLY SPONSORED RESEARCH AND DEVELOPMENT

Not Applicable.

FIELD OF THE INVENTION

This invention relates to food display, and more particularly to a food display system for a buffet line.

DISCUSSION OF RELATED ART

School cafeteria lines, buffet lines, and the like typically require food serving bins, tables, utensil storage, food tray storage, and the like. Typically such a food display line is set-up on a conventional 6-foot or 8-foot folding table, with trays and silverware containers set at one end and food display trays positioned on the rest of the table. Setting-up, tearing down, and storing such an arrangement is cumbersome since all of these elements are not easily moved or stored together.

Therefore, there is a need for a system that allows for most of the elements required to set-up a food service line to be moved and stored together. Such a system would provide for easy transport of the items as well as quick set-up and tear down thereof. The inventive system would further be aesthetically pleasing once deployed, and would aid in the education of the user concerning the food items and beverages that are presented. The present invention accomplishes these objectives.

SUMMARY OF THE INVENTION

The present device is a food display system for display food items on a table, such as a 6-foot or 8-foot conventional folding table. The food items are displayed on both sides of the table, and thus two buffet-style lines can be formed on either side of the table A cart has a front, a rear, two opposing sides, a top, and a bottom. The sides each include at least one tray storage recess. The top includes at least one bin storage area. The rear includes at least one bin holder and/or sign storage storage recess. Preferably the bottom of the cart further includes a plurality of coasters, such that the cart may be rolled along a ground surface. A plurality of nestable trays are each storable in the at least one tray storage recess of each side of the cart. A plurality of bins are each storable in the bin storage area of the top of the cart.

Preferably the cart further includes a display board fixed with the rear of the car. Such a display board has a food poster holder fixed with a front side thereof, such that a food poster may be fixed with the display board to educate the user concerning the food items.

In one embodiment, the cart further includes a crate shelf fixed with the front thereof, the crate shelf being movable between a collapsed position and a deployed position. Such a crate shelf when in the deployed position is adapted to hold a plurality of beverage crates that can be stocked with milk cartons or the like.

A plurality of nestable bin holders are each adapted for displaying at least one of the bins while resting on one of the tables. Preferably each bin holder is adapted to hold at least one of the bins at an inclined with respect to the table. Each bin holder is preferably adapted to hold at least two of the bins, at least one bin on each side of the table and each inclined away from a longitudinal axis of the table.

Each bin holder may further include a substantially vertical sign to educate the user concerning the food items held therein. Further, each sign may include a card holder for further displaying a food card to further educate the user concerning the food items held in the bin holder. In one embodiment, each bin holder and sign are color-coded to represent a different food group corresponding to the food items held therein.

Alternately, the bins are adapted to rest on the table directly without the bin holders, and a sign holding rack is included for holding the signs above their associated bins.

In a deployed configuration, the cart is positioned preferably in front of the table, and each of the bin holders is placed on the table and each holding at least one of the bins. The bins display the food items. The bin storage area is adapted to hold a plurality of eating utensils, such that a user may select eating utensils and a tray and continue along the table to select the food items from the bins.

In a collapsed configuration, the bin holders are mutually nested together and stored in the bin holder storage recess, the bins are nested together and stored in the bin storage area, and the trays are nested together and stored in the tray storage recess.

The present invention is a system that allows for most of the elements required to set-up a food service line to be moved and stored together. The present system provides for easy transport of the items as well as quick set-up and tear down thereof, all in a self-contained and portable/mobile unit. The inventive system is aesthetically pleasing once deployed, and aids in the education of the user concerning the food items and beverages that are presented. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 2:
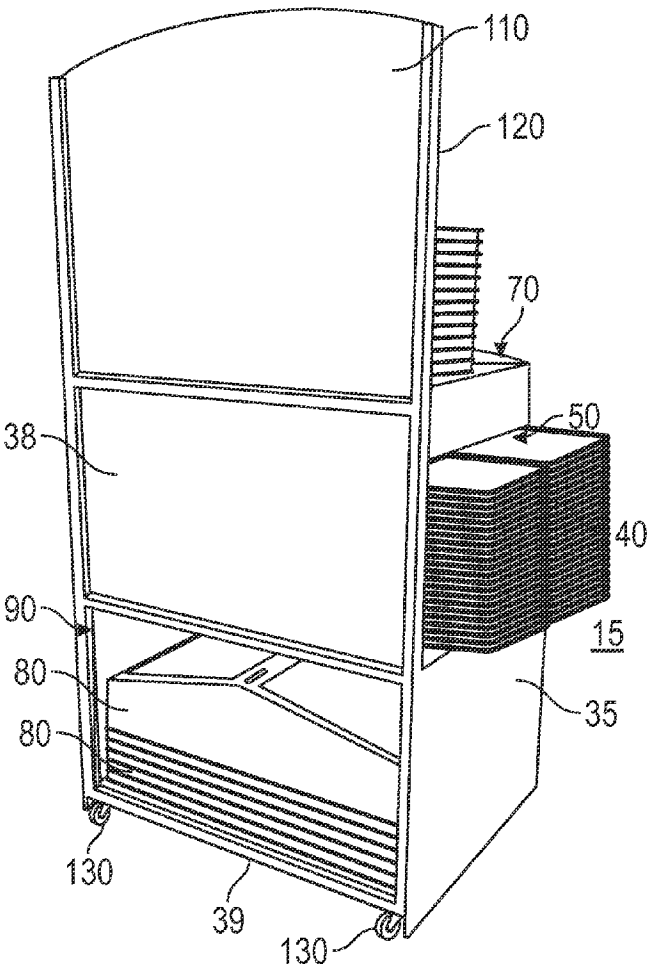
FIG. 2 is a rear perspective view thereof.
Figure 1:
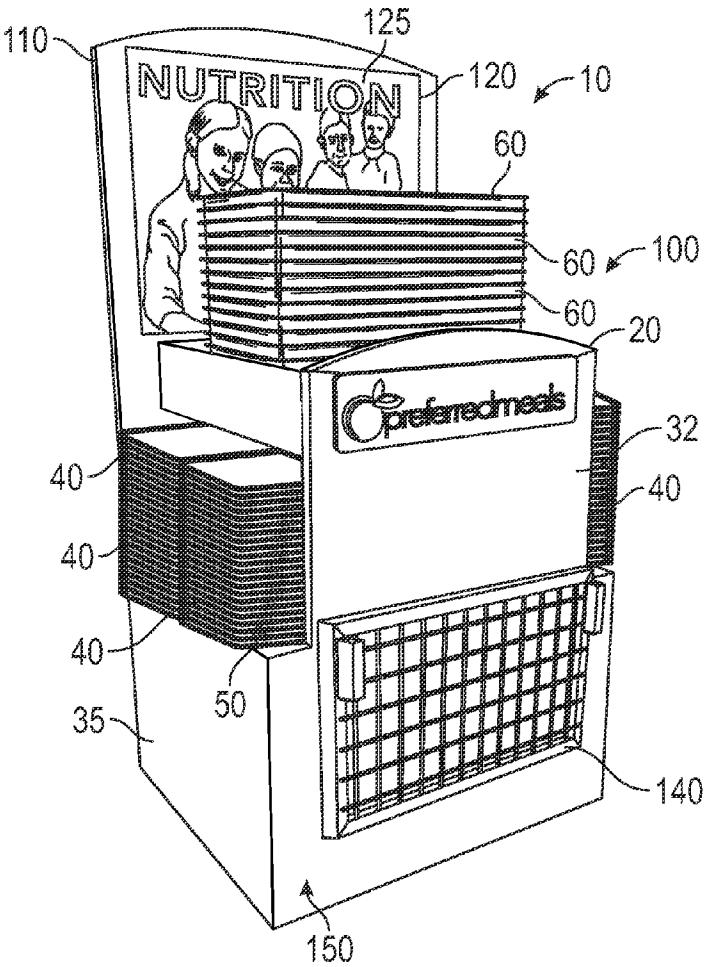
FIG. 1 is a front perspective view of the invention, illustrated in a collapsed configuration.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a food display system 10 for display food items 18 on a table 20 (FIG. 3), such as a 6-foot or 8-foot conventional folding table 20. The food items are displayed on both sides of the table 20, and thus two buffet-style lines can be formed on either side of the table 20. It is understood that herein the singular of table 20 may also mean more than one table 20, depending on how many food items 18 are to be offered, and in fact preferably the system is used with multiple tables 20.

A cart 30 has a front 32, a rear 38, two opposing sides 35, a top 31, and a bottom 39. The cart 30 is made from a suitably rigid wood, laminate, plastic, or metallic material that is durable and relatively easy to clean. The sides 35 each include at least one tray storage recess 50. The top 31 includes at least one bin storage area 70. The rear 38 includes at least one bin holder storage recess 90. Preferably the bottom 39 of the cart 30 further includes a plurality of coasters 130, such that the cart 30 may be rolled along a ground surface 15. Such coasters 130 may include food-depressed brakes (not shown) to prevent rolling of the cart 30 after the cart 30 is properly positioned. A plurality of nestable trays 40 are each storable in the at least one tray storage recess 50 of each side 35 of the cart 30. A plurality of bins 60 are each storable in the bin storage area 70 of the top 31 of the cart 30.

Preferably the cart 30 further includes a display board 110 fixed with the rear 38 of the car 30. Such a display board 110 has a food poster holder 120 fixed with a front side thereof, such that a food poster 125 may be fixed with the display board 110 to educate the user concerning the food items 18. The rear 38 of the card 30 and the rear of the display board 110 may further include shelves (not shown) for holding sign connectors (not shown) and other items.

Figure 3:
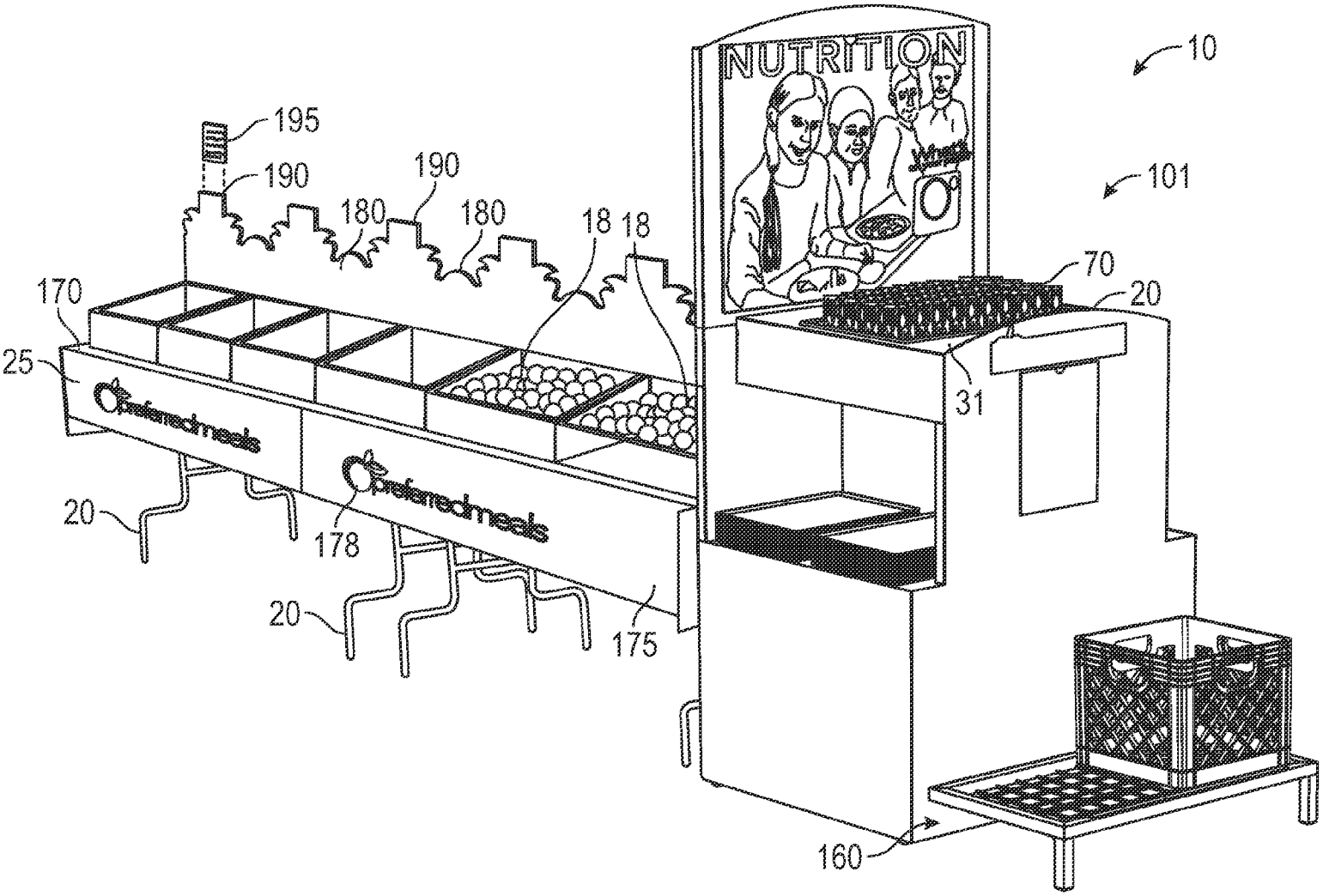
FIG. 3 is a front perspective view of the invention, illustrated in a deployed configuration.
Figure 4:
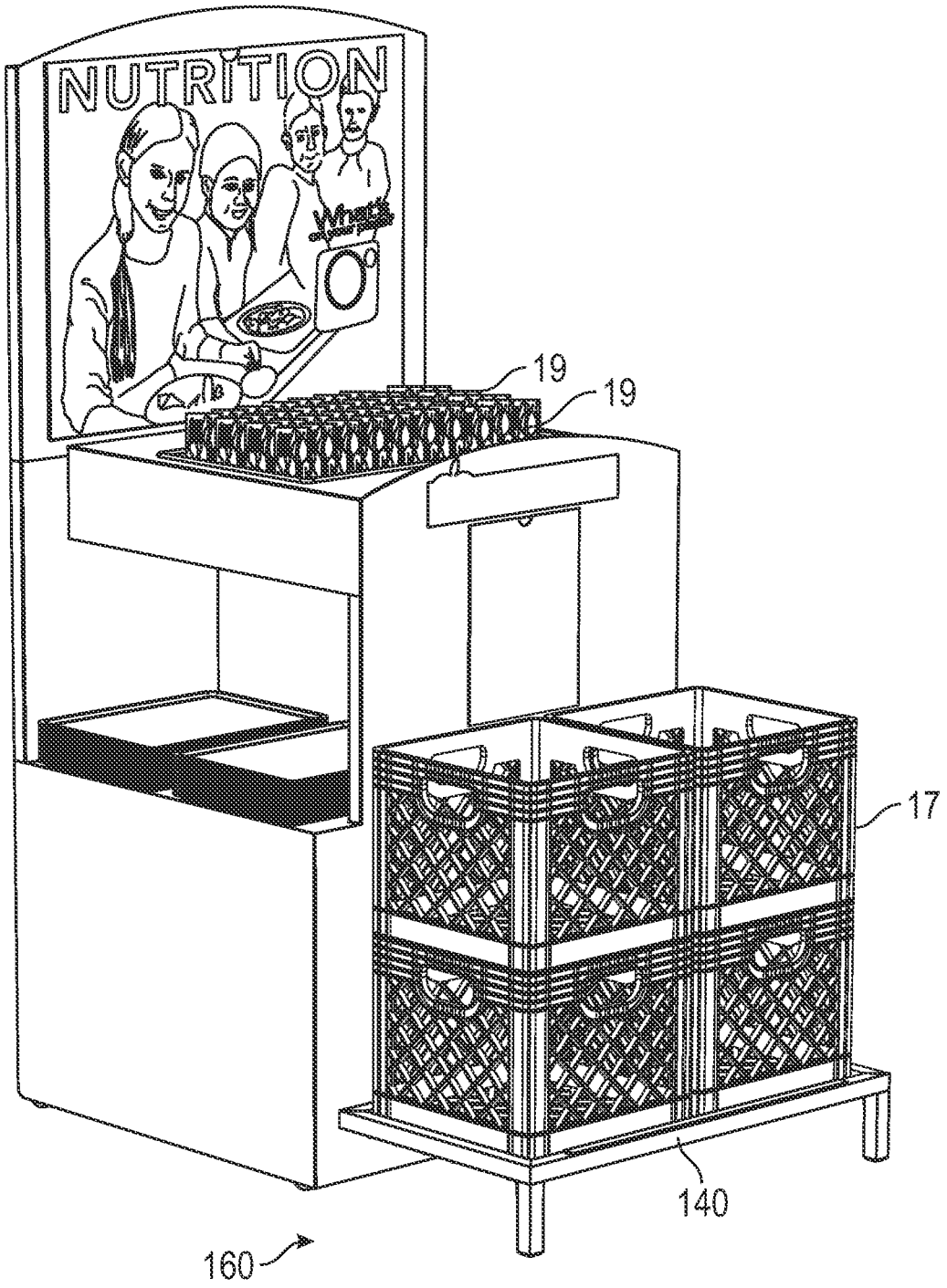
FIG. 4 is an enlarged perspective view of FIG. 3 with a table omitted for clarity of illustration.
Figure 5:
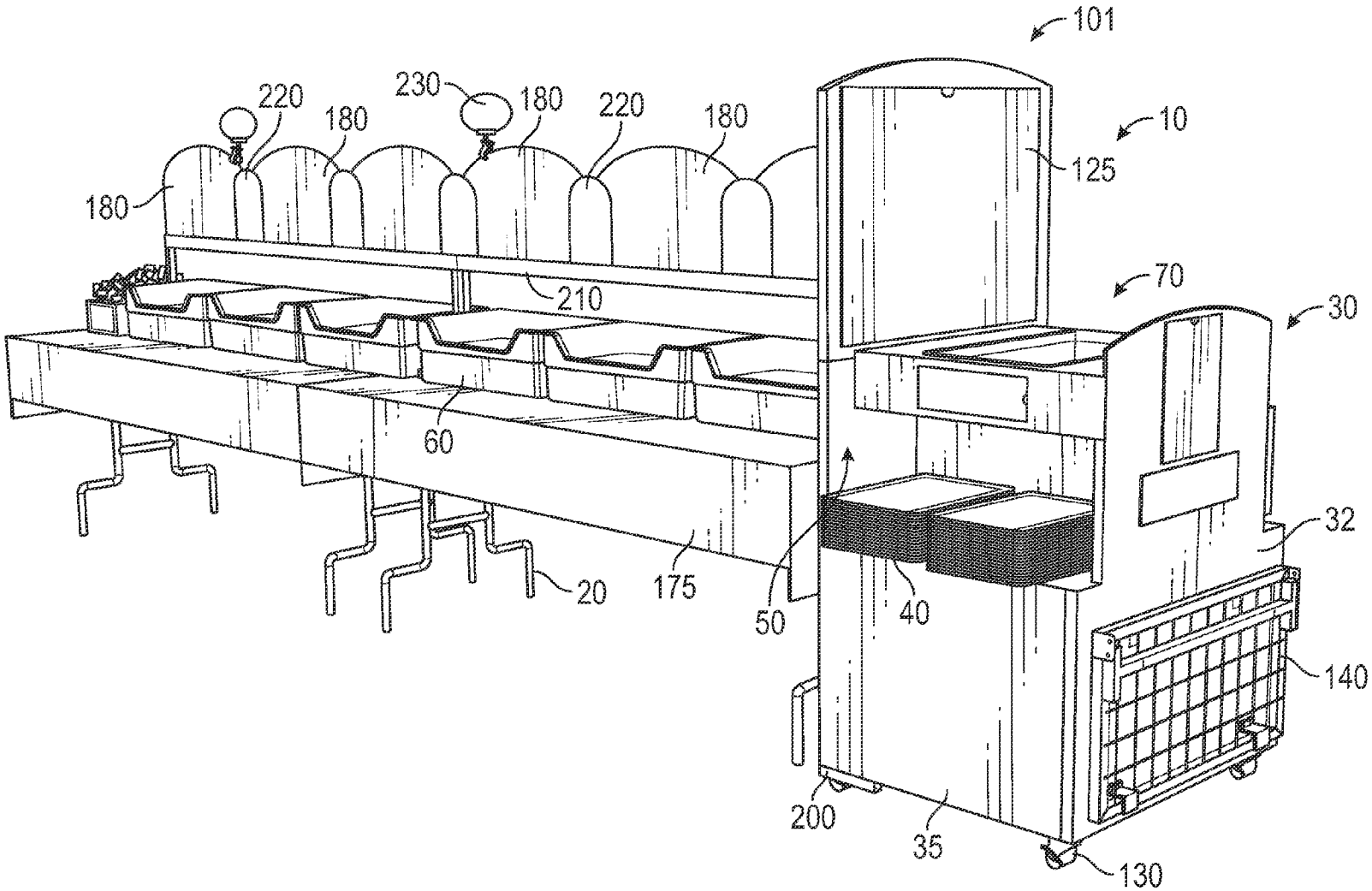
FIG. 5 is a front perspective view of an alternate embodiment of the invention, illustrated in the deployed configuration.
Figure 6:
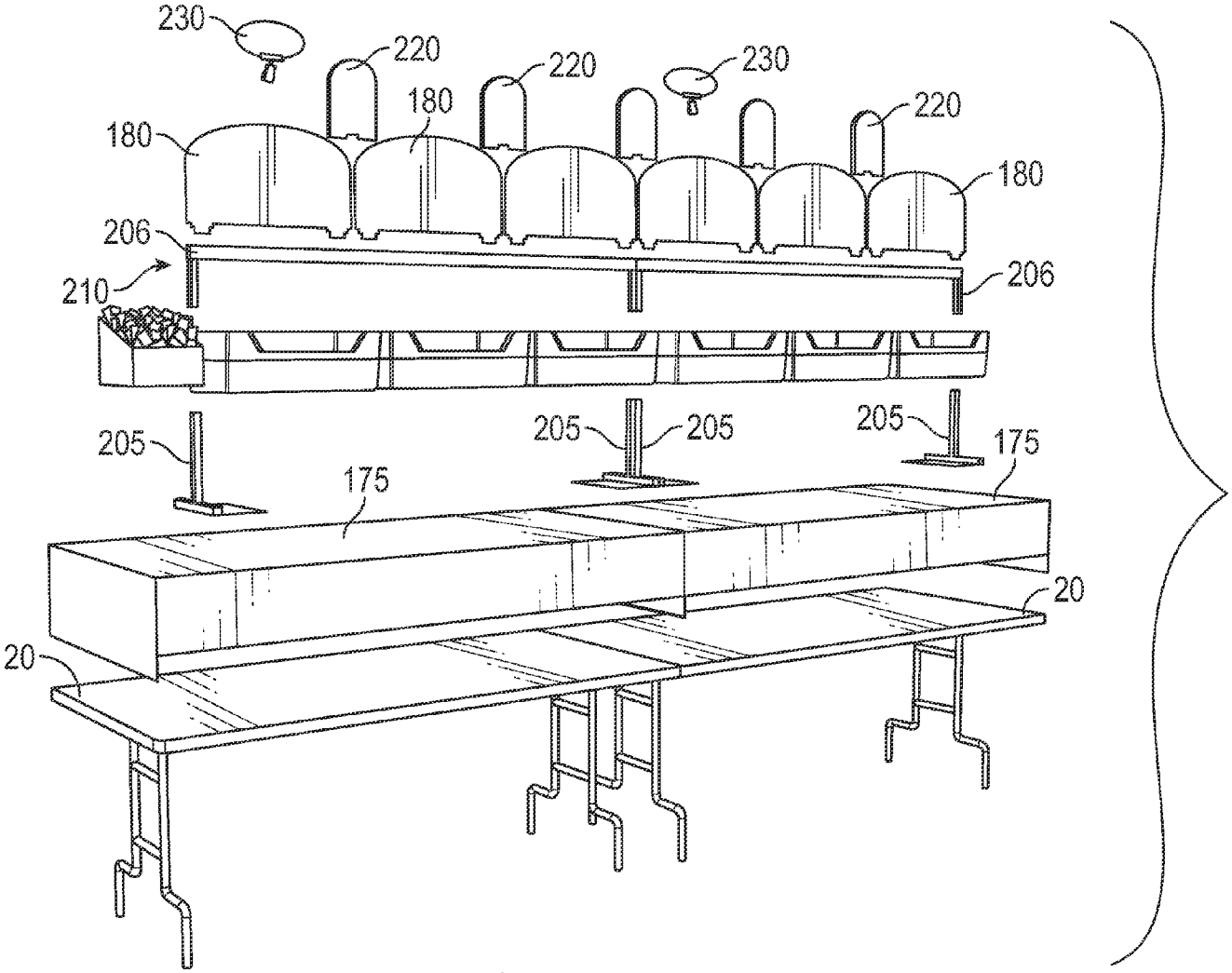
FIG. 6 is an exploded perspective view of FIG. 5, a cart of the invention omitted for clarity of illustration.
Figure 7:
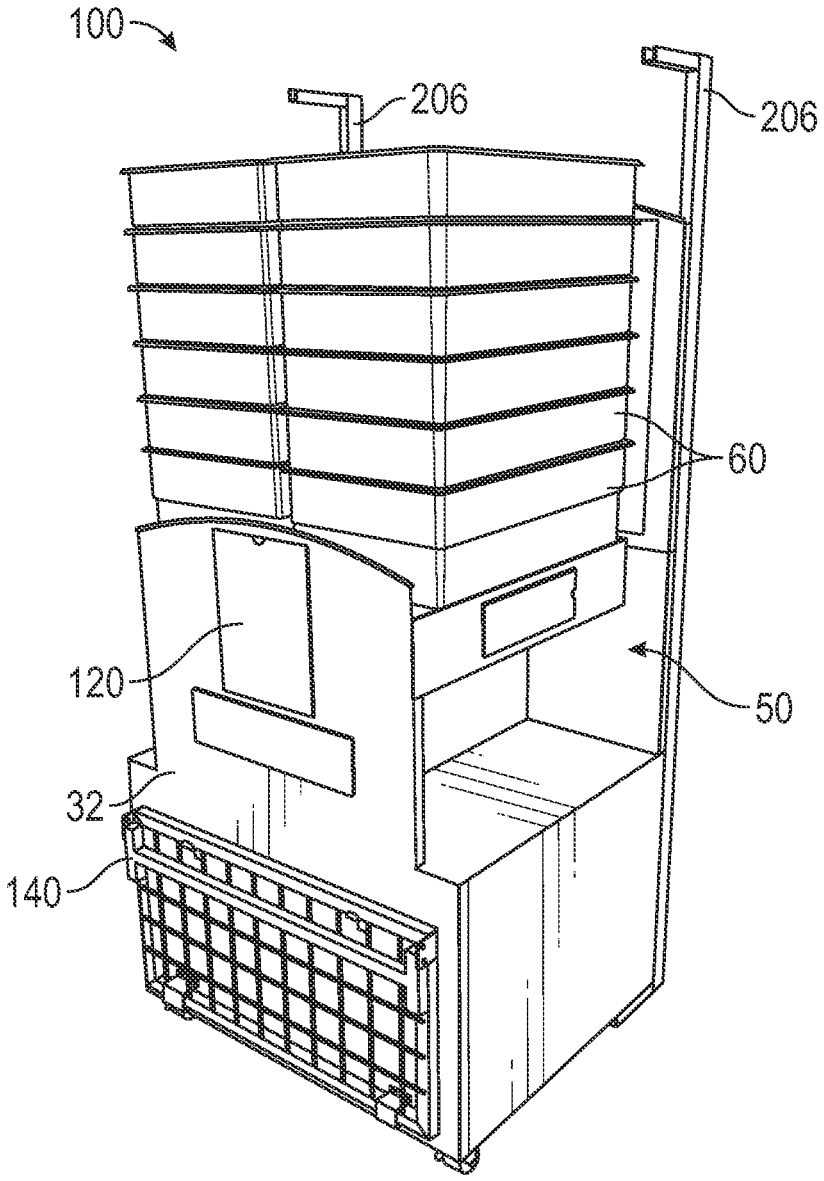
FIG. 7 is a front perspective view of the alternate embodiment, illustrated in the collapsed configuration.
Figure 8:
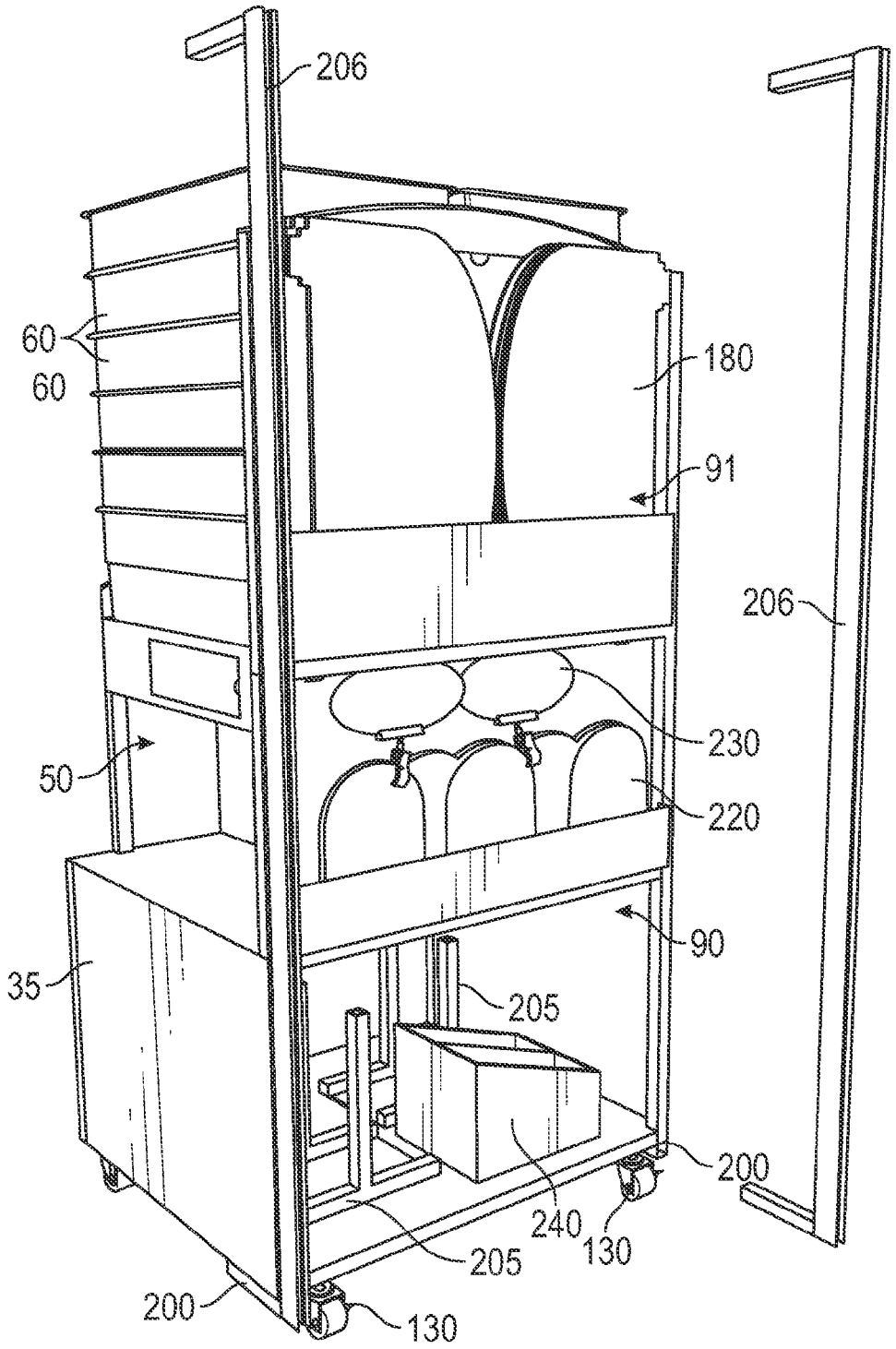
FIG. 8 is a rear perspective view, partially exploded, of FIG. 7.

In one embodiment, the cart 30 further includes a crate shelf 140 fixed with the front 32 thereof, the crate shelf 140 being movable between a collapsed position 150 (FIG. 1) and a deployed position 160 (FIGS. 3 and 4). Such a crate shelf 140 when in the deployed position 160 is adapted to hold a plurality of beverage crates 17 that can be stocked with milk cartons (not shown) or the like.

In one embodiment, the system 10 may include a tablecloth 170 (FIG. 3) adapted to fit over each of the tables 20. Such a tablecloth 170 may include a skirt portion 175 having indicia 178 adapted to cooperative with the plurality of bin holders 80.

A plurality of nestable bin holders 80 are each adapted for displaying at least one of the bins 60 while resting on one of the tables 20. Preferably each bin holder 80 is adapted to hold at least one of the bins 60 at an inclined angle $\alpha$, such as between 5 and 45 degrees towards the edge 25 of the table 20 with respect to the table 20. Each bin holder 80 is preferably adapted to hold at least two of the bins 60, at least one bin 60 on each side of the table 20 and each inclined away from a longitudinal axis of the table 20.

Each bin holder 80 may further include a substantially vertical sign 180 (FIG. 3) to educate the user concerning the food items 18 held therein. Further, each sign 180 may include a card holder 190 for further displaying a food card 195 to further educate the user concerning the food items 18 held in the bin holder 80. In one embodiment, each bin holder 80 and sign 180 are color-coded to represent a different food group corresponding to the food items 18 held therein.

In a deployed configuration (FIG. 3), the cart 30 is positioned in front of the table 20, and each of the bin holders 80 is placed on the table 20 and each holding at least one of the bins 60. The bins 60 display the food items 18. The bin storage area 70 is adapted to hold a plurality of eating utensils 19, such that a user may select eating utensils 19 and a tray 40 and continue along the table 20 to select the food items 18 from the bins 60.

In a collapsed configuration (FIGS. 1 and 2), the bin holders 80 are mutually nested together and stored in the bin holder storage recess 90, the bins 60 are nested together and stored in the bin storage area 70, and the trays 40 are nested together and stored in the tray storage recess 50.

In one embodiment, a collapsible salad bar sneeze guard (not shown) may be included and supported by the table 20, the bin holders 80 fitting between two lateral upright supports. Additionally, a plurality of warming mats (not shown) may be included and stored within the cart 30. Still further, a stand-alone milk crate stand (not shown) may be included for holding a plurality of the beverage crates 17 adjacent to the cart 30 or table 20.

In an alternate preferred embodiment, illustrated in FIGS. 5-8, the bin holders 80 are omitted, the bins 60 each adapted for resting directly on the at least one table 20. Further, the food display system 10 includes at least one sign holding rack 210 comprising a pair of rack bases 205 and a rack top 206, the rack top 206 adapted for holding at least one of a plurality of the signs 180. Such a rack top 206 has, preferably, a groove in a top side thereof into which each sign 180 may be inserted and held thereby by gravity and friction. The rack top 206 is further adapted to hold at least one of a plurality of card guides 220 that are each adapted to fit between two adjacent of the signs 180 for securing the signs 180 together. Further, at least one sign rider 230 may be included, each sign rider 230 adapted for fixing with one of the signs 180 or one of the card guides 220.

The rear 38 of the cart 30 of such an embodiment further includes at least one sign storage recess 91 for holding the plurality of signs 180, sign riders 230, and card guides 220. A condiment holder 240 may be included and stored in the at least one sign storage recess 91, along with the plurality of rack bases 205 or other miscellaneous items as desired. In such an alternate embodiment, the cart 300 further includes at least one rack holder 200 such that in the collapsed configuration, each rack top 206 may be inserted into one of the rack holders 200, or otherwise engaged therewith to be held thereby.

Figure 9:
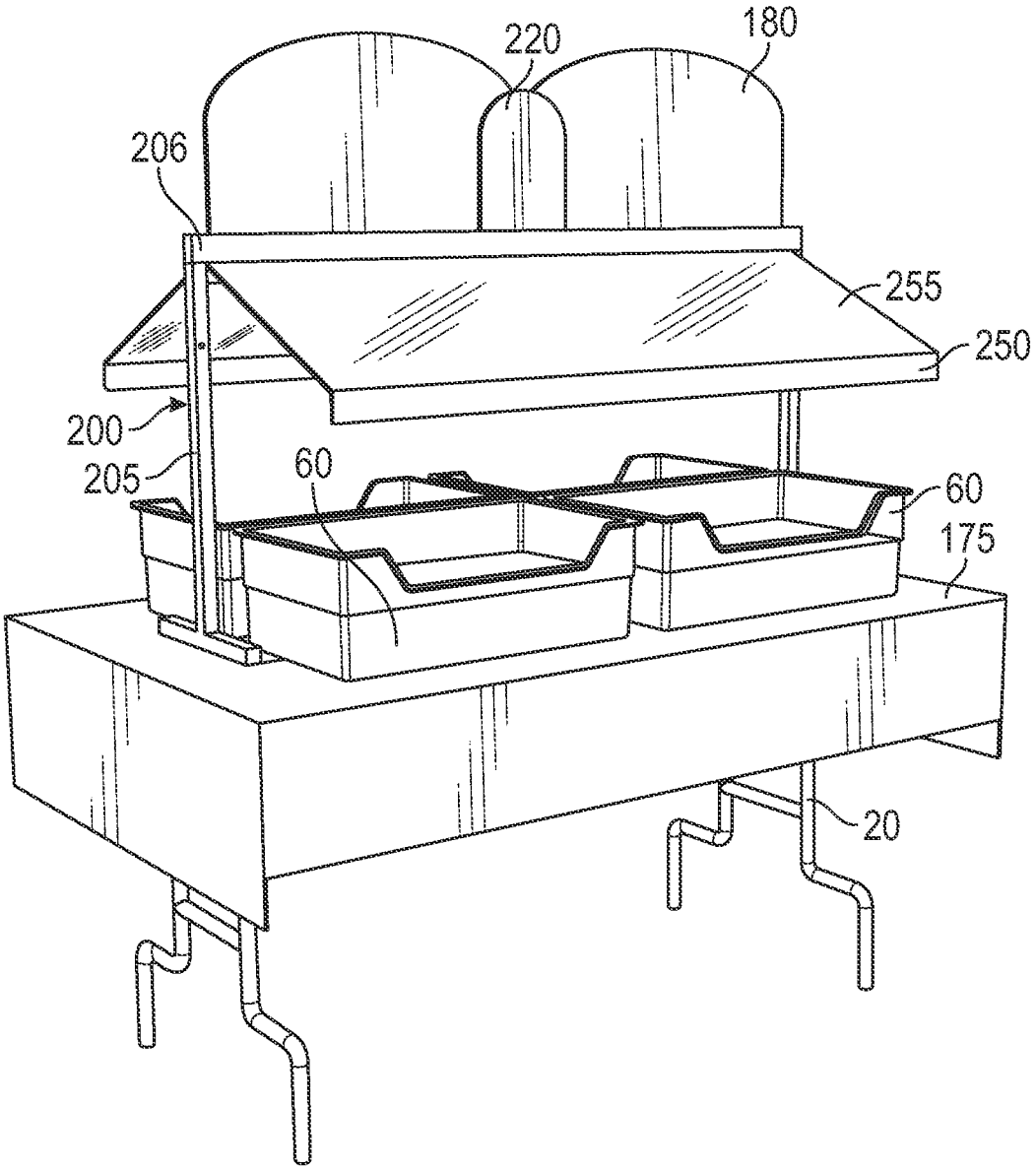
FIG. 9 is a front perspective view of an optional salad bar table having a sneeze-shield.

In one embodiment, the food display system 10 may further include a sneeze-shield 250 (FIG. 9) for protecting the food items 18. Such a sneeze-shield 250 may be included on an optional "salad bar" table, for example, and may have a smaller rack holder 200 for use on a shorter table 20. Such a sneeze-shield 250 projects away and down from the sign holding rack and has at least a portion 255 that is transparent, made from glass, polycarbonate, acrylic, or the like.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A food display system for displaying food items on at least one table, comprising:

a cart having a front, rear, two opposing sides, a top and a bottom, the sides each including at least one tray storage recess, the top including at least one bin storage area, the rear including at least one sign storage recess and at least one rack holder;

a plurality of nestable trays each storable in the at least one tray storage recess of each side of the cart;

a plurality of bins each storable in the bin storage area of the top of the cart; and at least one sign holding rack adapted for holding a plurality of signs, each sign adapted to be fixed above an associated one of the plurality of bins;

whereby the cart in a deployed configuration is positioned in front of the at least one table, the at least one sign holding rack is positioned on the at least one table and each sign is fixed therewith, and each one of the associated bins is set on one of the at least one table below said respective sign fixed thereabove and displaying the food items, the bin storage area adapted to hold a plurality of eating utensils such that a user may select eating utensils and one of said plurality of nestable trays and continue along the at least one table to select the food items from the bins, and whereby when the cart is in a collapsed configuration the at least one sign holding rack is affixed with one of the at least one rack holders of the cart, each sign is stored in the sign storage recess, the bins are nested together and stored in the bin storage area, and the trays are nested together and stored in the tray storage recess.

2. The food display system of claim 1 wherein the cart further includes a display board fixed with the rear of the cart, the display board having a food poster holder fixed with a front side thereof, whereby a food poster may be fixed with the display board to educate the user concerning the food items.

3. The food display system of claim 1 wherein the bottom of the cart further includes a plurality of coasters, whereby the cart may be rolled along a ground surface.

4. The food display system of claim 1 further including a crate shelf fixed with the front of the cart, the crate shelf movable between a collapsed position and a deployed position and adapted to hold a plurality of beverage crates.

5. The food display system of claim 1 further including at least one tablecloth adapted to fit over one of the at least one table, the at least one tablecloth including a skirt portion having indicia adapted to cooperate with the plurality of bins.

6. The food display system of claim 1 wherein each sign further includes a card holder for further displaying a food card to further educate the user concerning the food items held in the bin.

7. The food display system of claim 1 wherein each bin and sign is color coded to represent a different food group corresponding to the food items displayed by the bins.

8. The food display system of claim 1 wherein the at least one sign holding rack further includes a sneeze-shield, projecting away from the at least one sign holding rack and having at least a portion being transparent.

* * * * *